US005417503A

United States Patent [19]

Brennan, III

[11] Patent Number: 5,417,503

[45] Date of Patent: May 23, 1995

[54] POOL BLACK ALGAE SPOT TREATMENT TOOL

[76] Inventor: Charles V. Brennan, III, 11050 Daniels Dr., Nevada City, Calif. 95959

[21] Appl. No.: 224,688

[22] Filed: Apr. 8, 1994

[51] Int. Cl.[6] ..... B43K 23/00; B43K 21/22

[52] U.S. Cl. ..... 401/92; 401/93

[58] Field of Search ..... 401/93, 92

[56] References Cited

U.S. PATENT DOCUMENTS

| | | | |
|---|---|---|---|
| 1,816,545 | 7/1931 | Porter | 401/93 X |
| 2,687,116 | 8/1954 | Sheets | 401/93 |
| 4,247,216 | 1/1981 | Pansini | 403/109 |
| 5,002,182 | 3/1991 | McGinnis | 401/93 X |
| 5,110,230 | 5/1992 | Cole, Jr. et al. | 401/52 |

FOREIGN PATENT DOCUMENTS

| | | | |
|---|---|---|---|
| 12618 | 10/1910 | France | 401/93 |
| 195681 | 2/1938 | Switzerland | 401/93 |
| 309590 | 1/1956 | Switzerland | 401/92 |

*Primary Examiner*—Steven A. Bratlie

[57] ABSTRACT

A black algae spot treatment tool for attaching to a swimming pool pole for directly treating and eliminating black algae spots which typically build up on the plaster surfaces of a swimming pool. The tool includes a chlorine stick, a collet vise for clampedly slidably removably holding the chlorinating stick whereby a user may apply the chemical directly to a colony of black algae within the pool. The device also includes two holes laterally positioned opposite each other and located far enough up from the bottom of the tool for receiving a standard plastic "V" spring used throughout the art in the field for attaching tools to the end of pool poles whereby the user may treat black algae spots located below the water level without entering the pool.

1 Claim, 2 Drawing Sheets

POOL BLACK ALGAE SPOT TREATMENT TOOL

BACKGROUND OF THE INVENTION

1. Field of the Invention

The present invention relates to pool maintenance tools and more particularly pertains to pool black algae spot treatment tools which may be attached to a swimming pool pole for directly treating and eliminating black algae spots which build up on the plaster surfaces of swimming pools.

2. Description of the Prior Art

The use of pool cleaning tools is known in the prior art. More specifically, pool cleaning tools heretofore devised and utilized for the purpose of cleaning a swimming pool are known to consist basically of familiar, expected and obvious structural configurations, notwithstanding the myriad of designs encompassed by the crowded prior art which have been developed for the fulfillment of countless objectives and requirements.

The present invention is directed to improving devices for cleaning swimming pools in a manner which is safe, secure, economical and aesthetically pleasing.

For example, U.S. Pat. No. 5,110,230 to Cole, Jr. et al. discloses an adjustable swimming-pool cleaning tool for use as an attachment for a standard pool pole which includes a double-faced remotely pivotable head with a key-sprocket locking mechanism.

U.S. Pat. No. 5,018,890 to May discloses a pool cleaning system including a cart for containing an electrically powered pump, a line to an external source of muriatic acid or other suitable cleaning agent, a line to a clean water source, a cleaning wand with a head, a cleaning agent solution regulating valving system,and a cleaning agent recirculating system.

Both of the above disclosed inventions have a relatively high cost of manufacture, with the May Pool Cleaning System being generally unsuitable for home pool use because of high cost and complexity.

U.S. Pat. No. 4,114,321 to Jarvis et al. describes a pool hand cleaning device holder is provided with a fixed clamp Jaw on one end of a rectangular base and a slidable opposing clamp jaw for holding various sizes of commercial swimming pool cleaning blocks and devices. A pole handle adapter incorporating an elongated concave adapter arm with attachment flanges that attach to attachment flanges on the base which allows the rectangular base to be set at various angles. The pool cleaning device holder shown must be used with extreme care because of the potentially pool-liner-damaging sharp metal corners and protruding hardware.

The prior art also discloses a buoyant boat bottom brush as shown in U.S. Pat. No. 3,010,420 to Glynn which consists of a buoyant cleaning head pivotally connected to a multiple-pivotal-jointed pole arm. The multiple pivoting Joints included in the pole of the device disclosed provide a flimsily constructed handle that will not provide the leverage needed to scrub swimming pool surfaces.

A swimming pool cleaning device is disclosed in the Keller U.S. Pat. No. 4,542,549 which describes a wheeled hand-propelled scrubbing device for the upper edge portions of swimming pool side walls near the water level. This device is limited to use cleaning the water line area only, the disclosure does not suggest a way to clean other pool surfaces, or to treat black algae spots.

In this respect, the pool black algae spot treatment tool according to the present invention substantially departs from the conventional concepts and designs of the prior art, and in so doing provides an apparatus primarily developed for the purpose of attaching to a swimming pool pole for directly treating and eliminating black algae spots which build up on the plaster surfaces of swimming pools.

Therefore, it can be appreciated that there exists a continuing need for new and improved pool black algae spot treatment tools which can be attached to a swimming pool pole for directly treating and eliminating black algae spots which build up on the plaster surfaces of swimming pools. In this regard, the present invention substantially fulfills this need.

As illustrated by the background art, efforts are continuously being made in an attempt to develop devices for cleaning swimming pools. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of pool cleaning tools now present in the prior art, the present invention provides an improved pool black algae spot treatment tool construction wherein the same can be utilized for attaching to a swimming pool pole for directly treating and eliminating black algae spots which build up on the plaster surfaces of swimming pools. As such, the general purpose of the present invention, which will be described subsequently in greater detail, is to provide a new and improved pool black algae spot treatment tool apparatus and method which has all the advantages of the prior art pool black algae spot treatment tools and none of the disadvantages.

The invention is defined by the appended claims with the specific embodiment shown in the attached drawings. For the purpose of summarizing the invention, the invention may be incorporated into a new and improved pool black algae spot treatment tool for attaching to a swimming pool pole for directly treating and eliminating black algae spots which build up on the plaster surfaces of swimming pools. The pool black algae spot treatment tool comprises collet means having a bore diameter and length such that a standard pool chlorinating stick or the like may be slidably removably retained therein. The collet means has a locking ring slidably disposed therearound whereby the collet may be locked or unlocked. The pool black algae spot treatment tool also includes two holes which appears laterally opposite each other and located far enough up from the bottom of said tool for receiving a standard plastic "V" spring used throughout the art in the field for attaching tools to the end of pool poles.

There has thus been outlined, rather broadly, the more important features of the invention in order that the detailed description thereof that follows may be better understood, and in order that the present contribution to the art may be better appreciated. In as much as the foregoing has outlined rather broadly the more pertinent and important features of the present invention in order that the detailed description of the invention that follows may be better understood so that the present contribution to the art can be more fully appreciated. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Therefore, it is an object of the present invention to provide a new and improved pool black algae spot treatment tool for attaching to a swimming pool pole for directly treating and eliminating black algae spots which build up on the plaster surfaces of swimming pools, the pool black algae spot treatment tool comprising: a collet vise for clampedly slidably removably holding a swimming pool chlorinating stick or the like whereby a user may apply the chemical directly to a colony of black algae within the pool, and; two holes which appears laterally opposite each other and located far enough up from the bottom of said tool for receiving a standard plastic "V" spring used throughout the art in the field for attaching tools to the end of pool poles whereby the user may treat spots located below the water level without entering the pool.

It is another object of the present invention to provide a new and improved black algae spot treatment tool which may be easily and efficiently manufactured and marketed.

It is a further object of the present invention to provide a new and improved pool black algae spot treatment tool which is of a durable and reliable construction.

An even further object of the present invention is to provide a new and improved pool black algae spot treatment tool which is susceptible of a low cost of manufacture with regard to both materials and labor, and which accordingly is then susceptible of low prices of sale to the consuming public, thereby making such pool black algae spot treatment tools economically available to the buying public.

Still yet another object of the present invention is to provide a new and improved pool black algae spot treatment tool which provides in the apparatuses and methods of the prior art some of the advantages thereof, while simultaneously overcoming some of the disadvantages normally associated therewith.

Still yet another object of the present invention is to provide a new and improved pool black algae spot treatment tool which is compatible with existing standard pool maintenance tools and supplies.

Yet another object of the present invention is to provide a new and improved pool black algae spot treatment tool which will not abrade the surface of the swimming pool, such abrasion creating a medium which tends to encourage future black algae growth.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
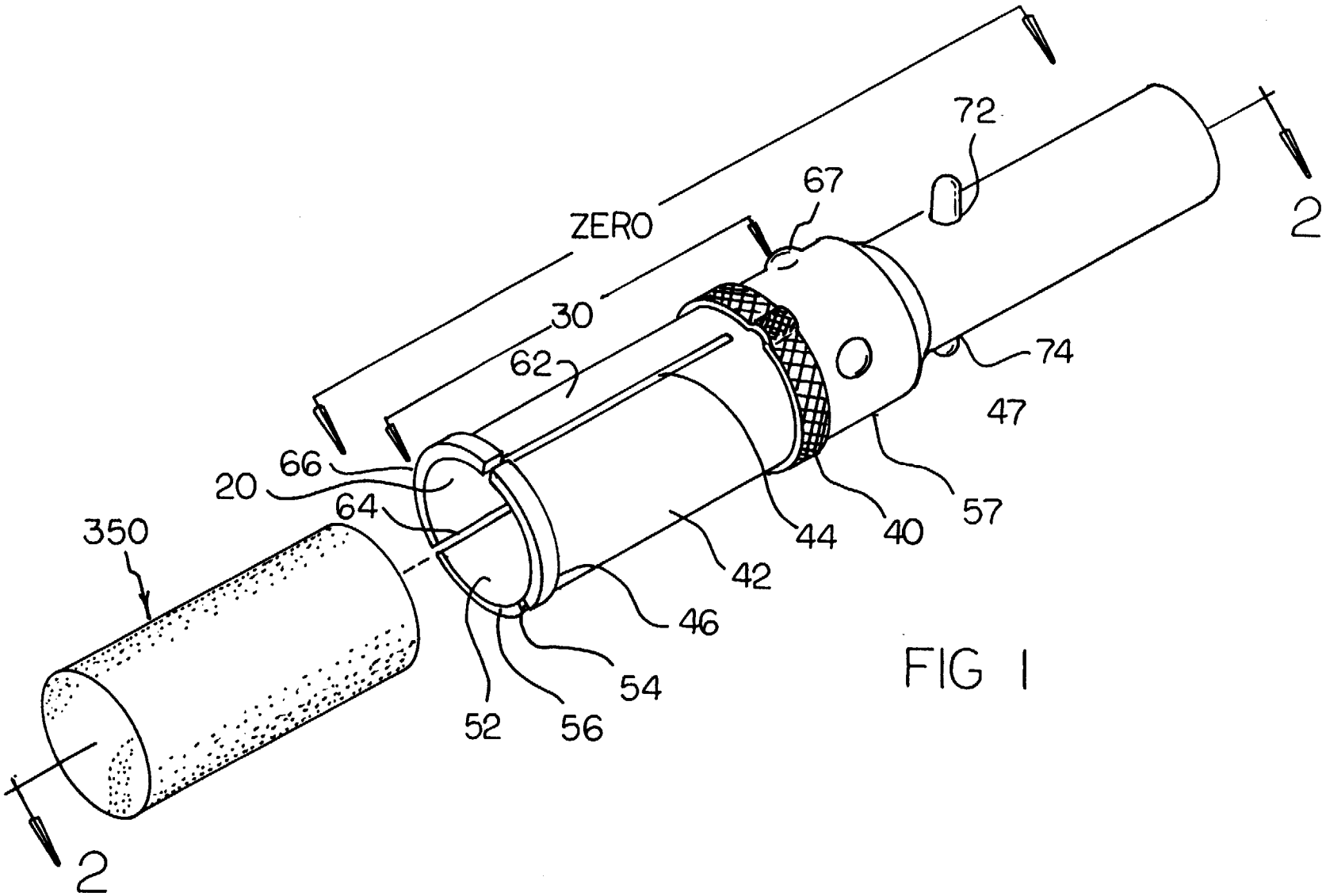
FIG. 1 is a perspective view of the present invention.

With reference now to the drawings, and in particular to FIG. 1 thereof, a new and improved pool black algae spot treatment tool embodying the principles and concepts of the present invention and generally designated by the reference numeral zero will be described.

From an overview standpoint, the black algae spot treatment tool is adapted for use with a swimming pool pole for directly treating and eliminating black algae spots which build up on the plaster surfaces of swimming pools. See FIG. 1.

Figure 2:
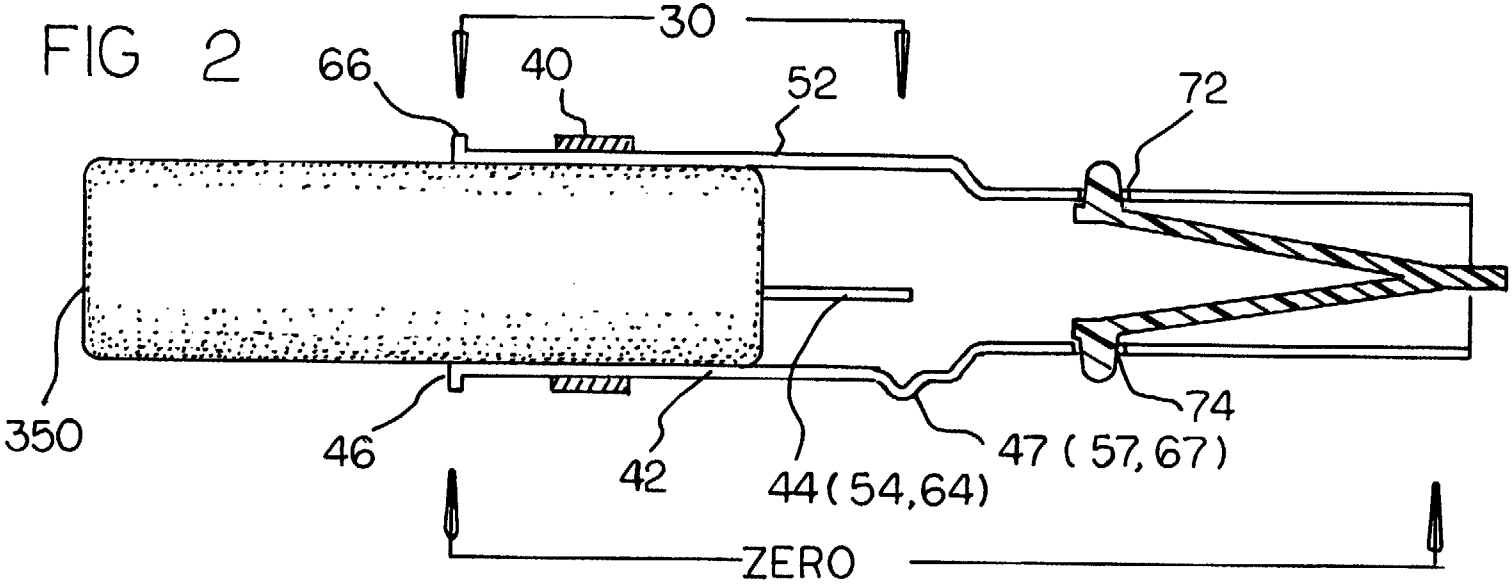
FIG. 2 is a sectional view of the invention of Figure taken along the line 2—2.

With reference now to FIGS. 1 and 2, more specifically, it will be noted that the black algae spot treatment tool for attaching to a swimming pool pole for directly treating and eliminating black algae spots which build up on the plaster surfaces of a swimming pool is shown. The pool black algae spot treatment tool comprises a tubular body having at its top end a cylindrical collet means 30 having a bore 20 diameter and length such that a standard pool chlorinating stick 350 or the like may be slidably removably retained therein.

The collet means 30 includes a plurality of resilient longitudinal fingers 42, 52 and 62 alternating with longitudinal slots 64, 44 and 54. The outside diameter of the collet means 30 is tapered slightly outward from bottom to top and includes a locking ring 40 slidably disposed therearound whereby the collet 30 may be locked to retain the chlorinating stick 350 or unlocked to release the chlorinating stick 350.

The collet means 30 further includes on the end of each finger retaining nails 46, 56 and 66 folded backward for the sole purpose of providing stops whereby the locking ring 40 is slidably captivated on the fingers 42, 52 and 62. The pool black algae spot treatment tool comprises at its bottom end a pair of laterally opposite holes 72 and 74 therethrough. These two laterally opposite holes 72 and 74 located far enough up from the bottom of the pool black algae spot treatment tool are there to receive a standard plastic "V" spring used throughout the art in the field for attaching and locking pool tools to the end of a pool pole.

The bottom end also includes 3 (three) bumps 47, 57 and 67 located just below the 3 fingers 42, 52 and 62 for the sole purpose of which is to prevent the locking ring 40 from sliding off of the black algae stick tool from the bottom end.

Figure 3:
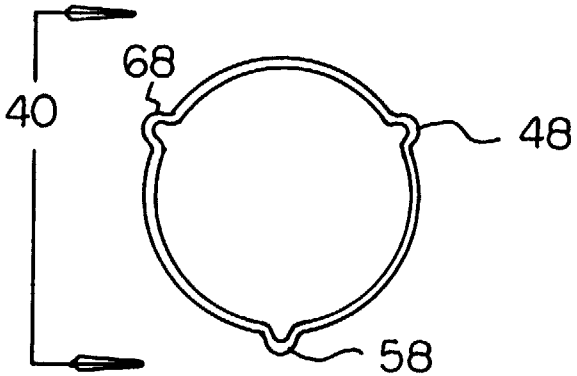
FIG. 3 is a sectional view of the locking ring used on the present invention.

With reference now to FIG. 3, the locking ring 40 contains 3 (three) humps 48, 58 and 68 for the express purpose of allowing the slidability of the locking ring onto the black algae stick tool from its bottom end; these humps 48, 58 and 68 make this possible to maneuver over the retaining bumps 47, 57 and 67.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A black algae spot treatment tool adapted for attaching to a swimming pool pole for directly treating and eliminating black algae spots which build up on the plaster surfaces of swimming pools, the black algae spot treatment tool comprising:

a cylindrically shaped chlorine stick;

a single tubular body having a top and a bottom;

the top including 3 symmetrically disposed fingers forming a collet vise of which the purpose is to retain and release the chlorinating stick, and a locking ring for sliding axially along the fingers for the purpose of clamping the chlorinating stick in place, each finger having a nail which is folded backwards for the purpose of providing stops for the locking ring to prevent the locking ring from sliding off the top of the black algae spot treatment tool; and the bottom having a circumference which allows it to slide into standard pool poles the bottom having two holes which are formed laterally opposite each other and located remote from the bottom for receiving a standard plastic "V" spring which then makes it possible to attach the black algae stick tool to a swimming pool pole, the bottom end having a plurality of radially disposed bumps located just below the fingers, the purpose of which is to prevent the locking ring from sliding off of the black algae stick tool from the bottom end.

* * * * *